US009889643B2

(12) United States Patent
Sakai

(10) Patent No.: US 9,889,643 B2
(45) Date of Patent: Feb. 13, 2018

(54) RECORDING DEVICE AND RECORDING METHOD

(71) Applicant: SEIKO EPSON CORPORATION, Tokyo (JP)

(72) Inventor: Hiroaki Sakai, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/122,494

(22) PCT Filed: Feb. 27, 2015

(86) PCT No.: PCT/JP2015/001059
§ 371 (c)(1),
(2) Date: Aug. 30, 2016

(87) PCT Pub. No.: WO2015/133109
PCT Pub. Date: Sep. 11, 2015

(65) Prior Publication Data

US 2017/0072684 A1 Mar. 16, 2017

(30) Foreign Application Priority Data

Mar. 7, 2014 (JP) ..... 2014-045722

(51) Int. Cl.
*B41J 2/045* (2006.01)
*B41J 29/38* (2006.01)
*B41J 29/02* (2006.01)

(52) U.S. Cl.
CPC ..... *B41J 2/04541* (2013.01); *B41J 2/04548* (2013.01); *B41J 2/04586* (2013.01); *B41J 29/02* (2013.01); *B41J 29/38* (2013.01)

(58) Field of Classification Search
CPC ..... B41J 2/04541; B41J 2/04548; B41J 2/04586; B41J 29/02; B41J 29/38
See application file for complete search history.

(56) References Cited

U.S. PATENT DOCUMENTS

2002/0171694 A1* 11/2002 Takayanagi ..... B41J 2/04518 347/5

FOREIGN PATENT DOCUMENTS

| | | | |
|---|---|---|---|
| JP | 62025077 | A | 2/1987 |
| JP | 2000190593 | A | 7/2000 |
| JP | 2005219288 | A | 8/2005 |
| JP | 2007243547 | A | 9/2007 |

(Continued)

OTHER PUBLICATIONS

ISR and Written Opinion dated May 8, 2015 for PCT/JP2015/001059.

*Primary Examiner* — Jason Uhlenhake
(74) *Attorney, Agent, or Firm* — Workman Nydegger

(57) ABSTRACT

A printer includes a base platform that has a support surface on which a medium is mounted, and a liquid ejecting unit, which is capable of moving relatively in a direction that runs along the support surface, and which performs a recording operation on the medium from a recording head that moves along the support surface in a direction that intersects the direction. The base platform includes a first power source device, and first control substrate that controls operation of the base platform on the basis of the first power source device, and the liquid ejecting unit includes a second power source device, and a second control substrate that controls operation of the liquid ejecting unit on the basis of the second power source device.

4 Claims, 4 Drawing Sheets

(56) References Cited

FOREIGN PATENT DOCUMENTS

| | | |
|---|---|---|
| JP | 2009-169738 | 7/2009 |
| JP | 2009-291995 | 12/2009 |
| JP | 2011-229209 | 11/2011 |
| JP | 2013190878 A | 9/2013 |

* cited by examiner

[Fig. 1]
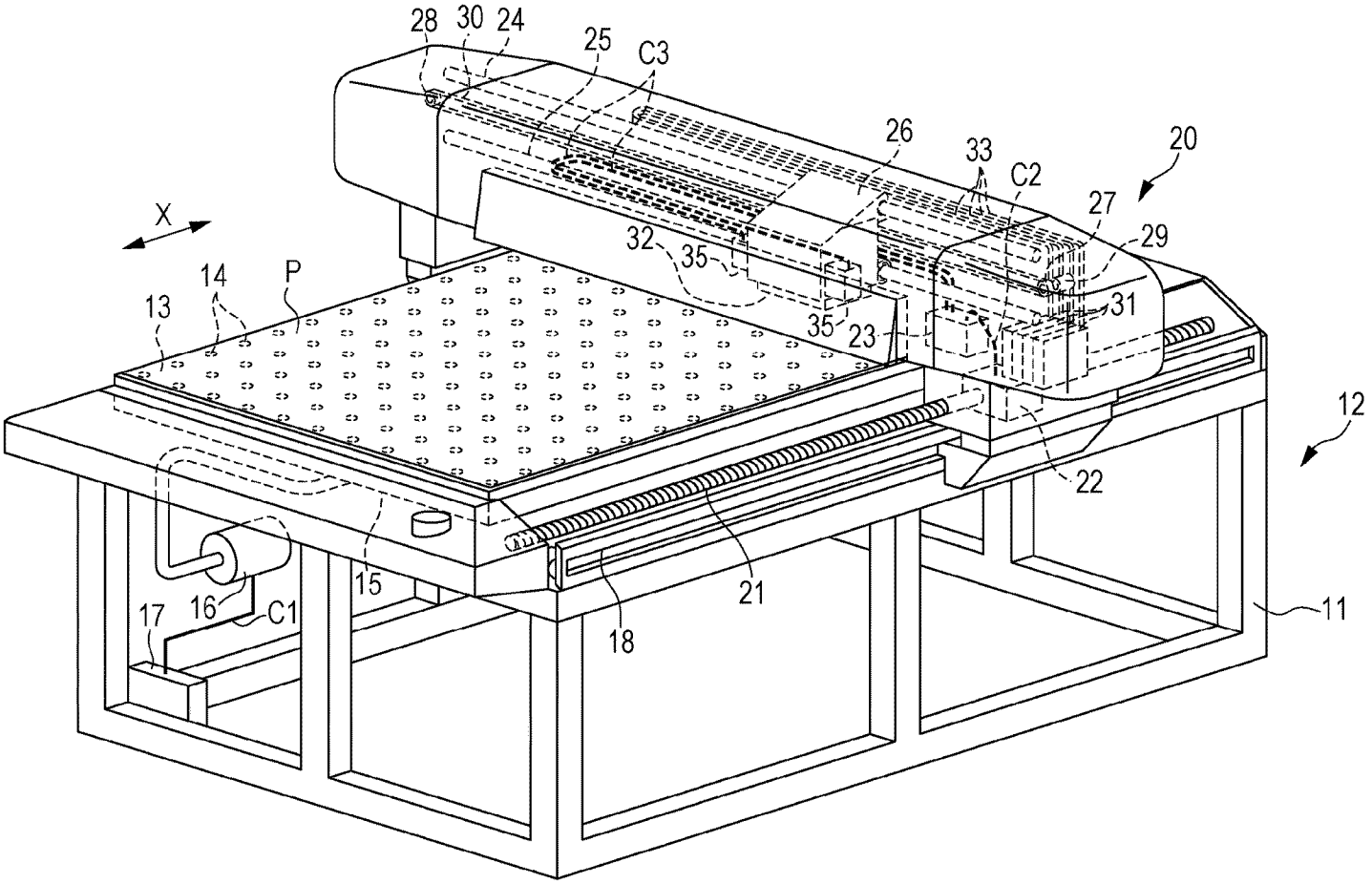

[Fig. 2]
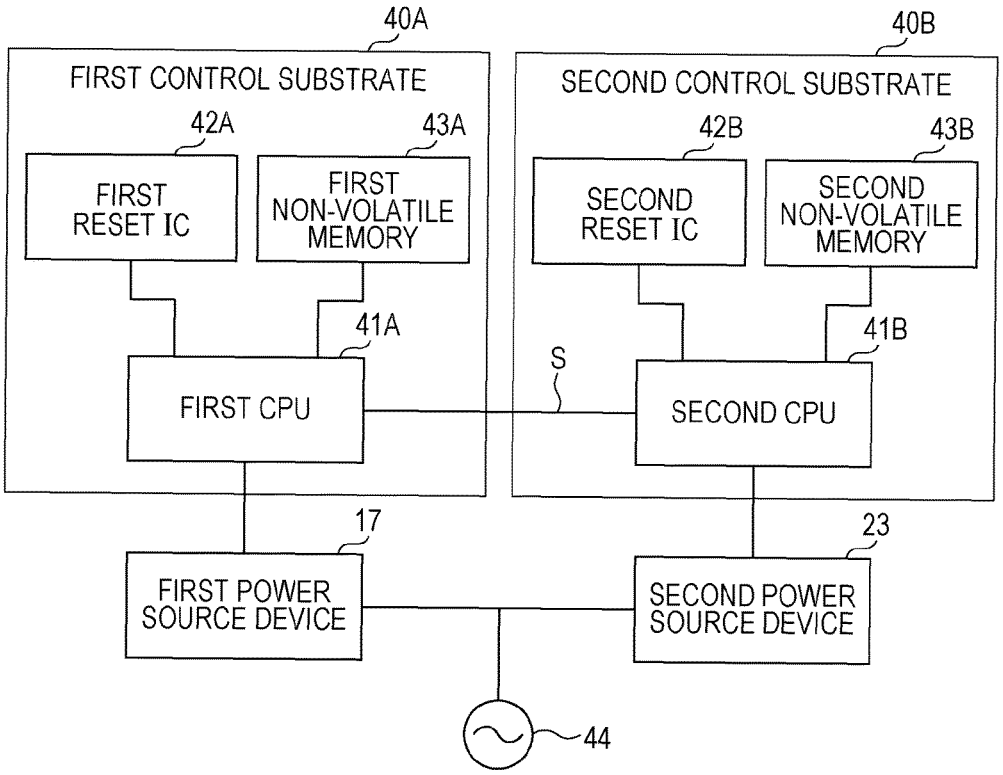

[Fig. 3]
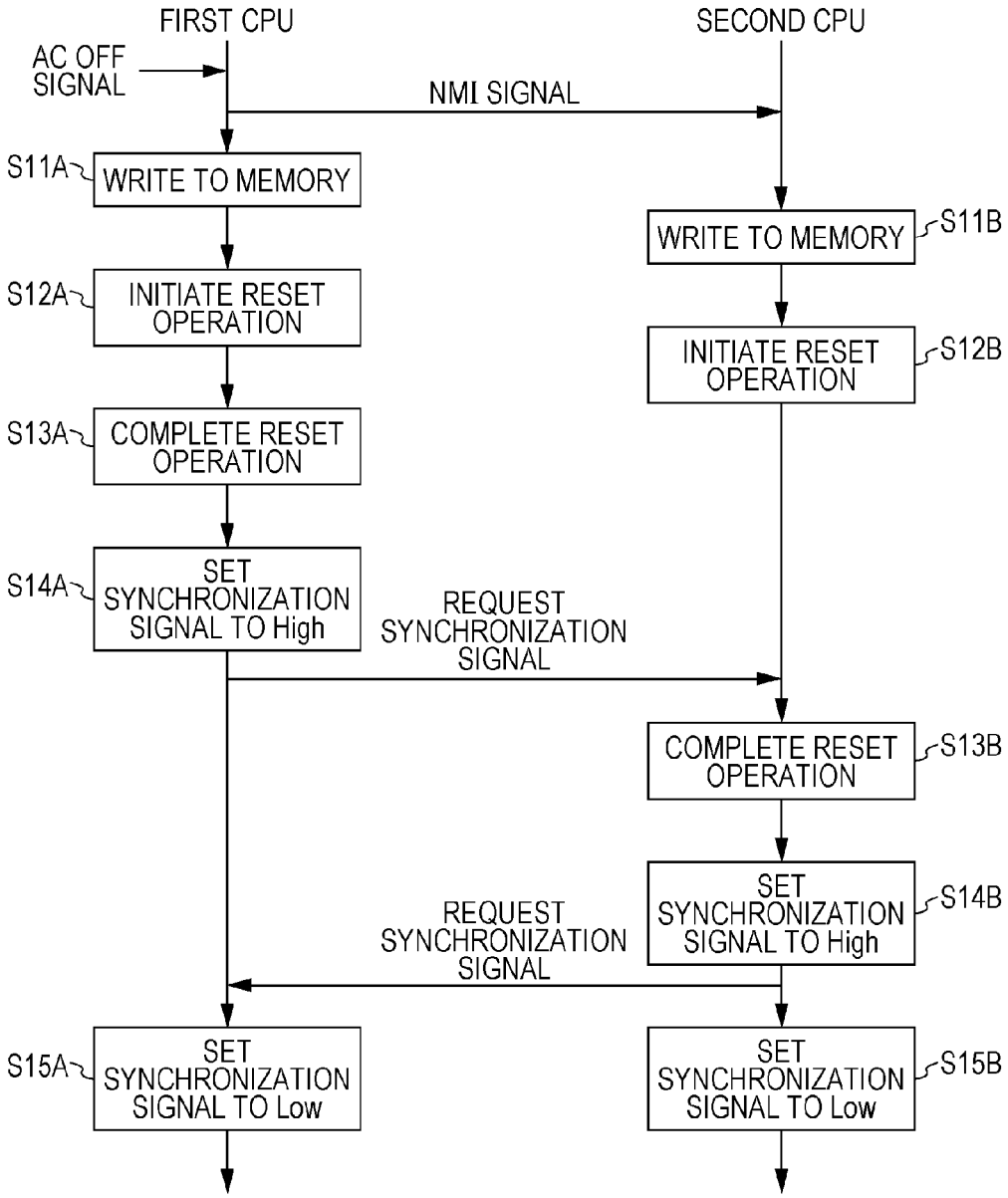

[Fig. 4]
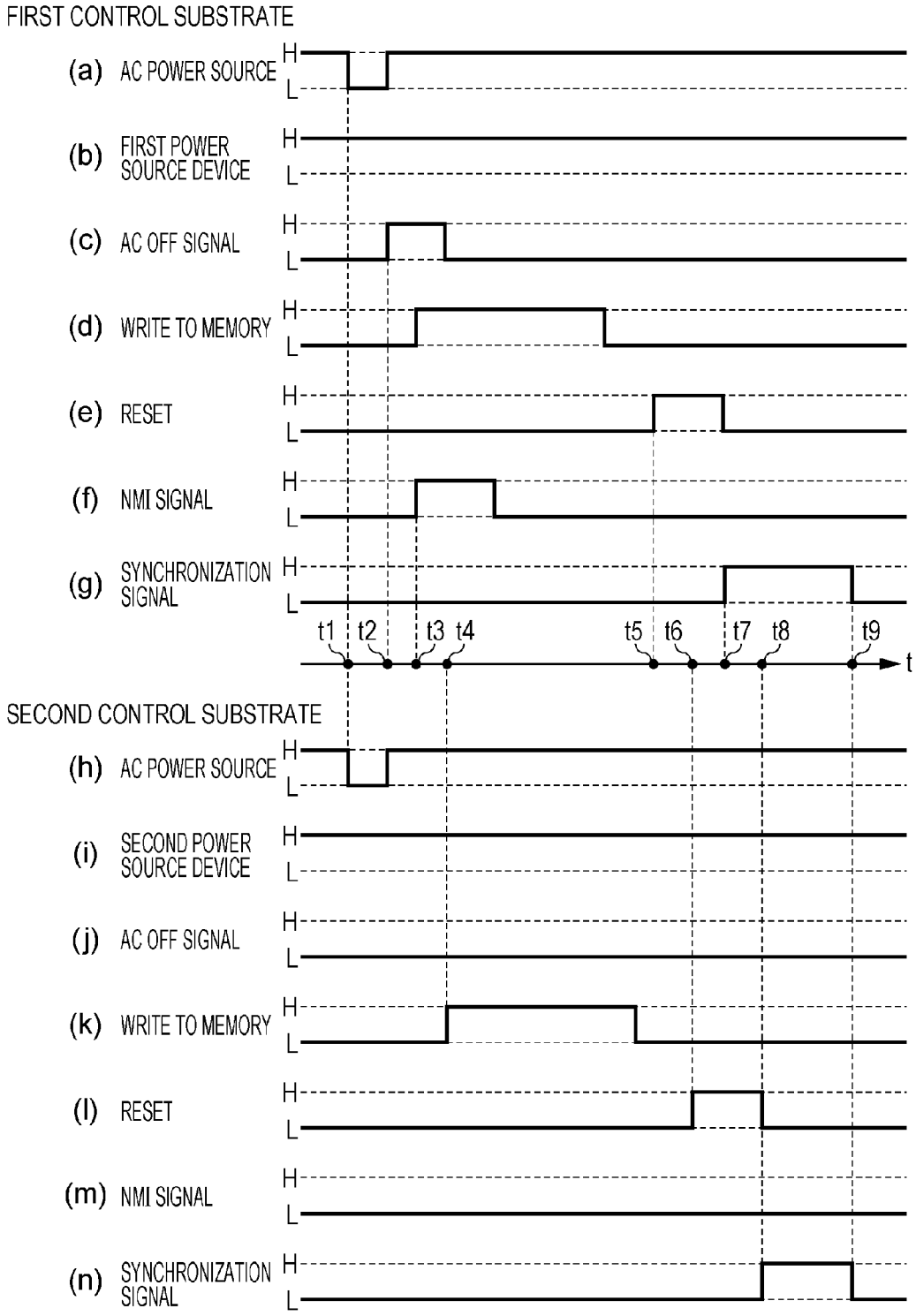

RECORDING DEVICE AND RECORDING METHOD

TECHNICAL FIELD

The present invention relates to a recording device that performs recording on a medium and a recording method that is used in a recording device.

BACKGROUND ART

In the related art, ink jet type printers, which are provided with a support table (a support unit) that includes a support surface on which a medium is supported, and a printing unit (recording unit), which is provided so as to extend over the top of the support table, and which is configured to be moveable along the support surface on the basis of drive power which is transmitted from a drive motor, are widely known as a kind of recording device (for example, refer to PTL 1). In printers that are configured in this manner, a printing head, which is built into a carriage, performs printing on a medium that is supported on a support surface while the carriage that configures a printing unit scans in a scanning direction, which is intersects a movement direction of the printing unit.

CITATION LIST

Patent Literature

PTL 1: JP-A-2009-291995

SUMMARY OF INVENTION

Technical Problem

Given that, in the abovementioned printers, a power source, which is to be a supply source of a voltage of an entire device that includes a printing unit, is arranged on a support table. Further, in a case in which a voltage is supplied to the printing unit from the power source, it is necessary to make a length of a cable that leads from the power source to the printing unit sufficiently long to an extent at which the cable does not interfere with movement of the printing unit. As a result of this, there is a problem in that it is more likely that a voltage drop will occur when supplying a voltage to the printing unit from the power source.

Accordingly, it is an object of the present invention to provide a recording device that can suppress the occurrence of a voltage drop in a voltage that is supplied to a recording unit, and a recording method that is used in the recording device.

Solution to Problem

According to an aspect of the invention, there is provided a recording device including: a support unit that includes a support surface that supports a medium; and a recording unit, which is capable of moving relatively in a direction that runs along the support surface with respect to the medium that is supported on the support unit, and which performs a recording operation on the medium from a recording head, in which the support unit includes a first power source, and a support control unit that controls operation of the support unit on the basis of power that is supplied from the first power source, and the recording unit includes a second power source, and a recording control unit that controls operation of the recording unit on the basis of power that is supplied from the second power source.

According to the abovementioned configuration, the recording unit includes the individual second power source that is separate from the first power source that is provided in the support unit. Therefore, even if a configuration in which the recording unit moves relatively in a direction that runs along the support surface with respect to the support unit, is used, a cable that leads from the second power source does not interfere with the relative movement. Therefore, as a result of the fact that shortening of the length of a cable that leads from the second power source is made possible, it is possible to suppress a voltage drop from occurring in a voltage that is supplied from the second power source to the recording unit through a cable.

In addition, in the abovementioned recording device, it is preferable that the support control unit and the recording control unit are capable of executing a reset operation that returns respective operational states to an initial state, and in a case in which one control unit of the support control unit and the recording control unit has initiated the reset operation, the corresponding control unit transmits a reset initiation signal, which initiates the reset operation after causing an operational state save operation to be performed, to the other control unit.

In addition, according to another aspect of the invention, there is provided a recording method that is used in a recording device that is provided with a support unit that includes a support surface that supports a medium, and a recording unit, which is capable of moving relatively in a direction that runs along the support surface with respect to the medium that is supported on the support unit, and which performs a recording operation on the medium from a recording head, in which the support unit includes a first power source, and a support control unit that controls operation of the support unit on the basis of power that is supplied from the first power source, and the recording unit includes a second power source, and a recording control unit that controls operation of the recording unit on the basis of power that is supplied from the second power source. The recording method causes the recording device to execute a power source OFF signal transmission step of transmitting a power source OFF signal, which shows that supply of power from the first power source and the second power source has been terminated, from the first power source and the second power source to the control units to which the first power source and the second power source correspond, and a reset initiation signal transmission step of transmitting a reset initiation signal, which initiates a reset operation, from a control unit to which the power source OFF signal was transmitted in the power source OFF signal transmission step to a partner control unit after causing an operational state save operation to be performed.

According to the abovementioned configuration or method, when one control unit of the support control unit and the recording control unit initiates a reset operation, an operational state save operation is performed in the other control unit, and a reset operation of the control unit is subsequently initiated. Therefore, since there is not a circumstance in which only one of the control units of the support control unit and the recording control unit performs a reset operation, it is possible to avoid a circumstance in which a communication error is generated between the control units.

In addition, in the abovementioned recording device, it is preferable that the support control unit and the recording control unit are capable of mutually transmitting a reset completion signal in a case in which the respective reset operations have been completed, and each control unit determines whether or not the reset operation of both control units has been completed on the basis of whether or not the reset completion signal has been transmitted from a partner control unit in a state in which a self-reset operation has been completed.

In addition, it is preferable that the abovementioned recording method further causes the recording device to execute a reset completion signal transmission step of mutually transmitting a reset completion signal in a case in which the support control unit and the recording control unit have completed the respective reset operations, and a reset completion determination step of causing each control unit determine whether or not the reset operations of both control units have been completed on the basis of whether or not the reset completion signal was transmitted from a partner control unit in the reset completion signal transmission step in a state in which a self-reset operation has been completed.

According to the abovementioned configuration or method, it is possible to determine whether or not a reset operation of both control units has been completed due to the support control unit and the recording control unit mutually transmitting a reset completion signal.

In addition, in the abovementioned recording device, it is preferable that each control unit terminates transmission of the reset completion signal to the partner control unit in a case in which the reset completion signal has been transmitted from the partner control unit in a state in which the self-reset operation has been completed.

In addition, it is preferable that the abovementioned recording method further cause the recording device to execute a reset completion signal termination step of causing each control unit to terminate transmission of the reset completion signal to the partner control unit in the reset completion determination step in a case in which it is determined that the reset operation of the partner control unit has been completed.

According to this configuration or method, since the transmission of the reset completion signal by each of the support control unit and the recording control unit to the partner control unit is not necessary after the reset operation of both control units has been completed, the transmission of the reset completion signal is terminated. Therefore, it is possible to avoid a circumstance in which the support control unit and the recording control unit transmit the reset completion signal over a period of time that is longer than necessary.

BRIEF DESCRIPTION OF DRAWINGS

FIG. 1 is a perspective view of an embodiment of a printer.

FIG. 2 is a block diagram that shows a control configuration of a printer of the same embodiment.

FIG. 3 is a flowchart that shows a process routine of a reset operation that the printer of the same embodiment executes.

FIG. 4 is a diagram that shows timing charts of the process routine of the reset operation that the printer of the same embodiment executes. Part (a) is a timing chart that shows a transition of an AC voltage that is supplied to a first power source device from an AC power source, Part (b) is a timing chart that shows a transition of a DC voltage that is supplied to a first CPU from the first power source device, Part (c) is a timing chart that shows a transition of a signal voltage of an AC OFF signal that is transmitted to the first CPU from the first power source device, Part (d) is a timing chart that shows a transition of a signal voltage of a memory writing signal that is transmitted to a first non-volatile memory from the first CPU, Part (e) is a timing chart that shows a transition of a signal voltage of a reset signal that is transmitted to the first CPU from a first reset IC, Part (f) is a timing chart that shows a transition of a signal voltage of an NMI signal that is transmitted to a second CPU from the first CPU, Part (g) is a timing chart that shows a transition of a signal voltage of a synchronization signal that is transmitted to the second CPU from the first CPU, Part (h) is a timing chart that shows a transition of an AC voltage that is supplied to a second power source device from an AC power source, Part (i) is a timing chart that shows a transition of a DC voltage that is supplied to the second CPU from the second power source device, Part (j) is a timing chart that shows a transition of a signal voltage of an AC OFF signal that is transmitted to the second CPU from the second power source device, Part (k) is a timing chart that shows a transition of a signal voltage of a memory writing signal that is transmitted to a second non-volatile memory from the second CPU, Part (l) is a timing chart that shows a transition of a signal voltage of a reset signal that is transmitted to the second CPU from a second reset IC, Part (m) is a timing chart that shows a transition of a signal voltage of an NMI signal that is transmitted to the first CPU from the second CPU, and Part (n) is a timing chart that shows a transition of a signal voltage of a synchronization signal that is transmitted to the first CPU from the second CPU.

DESCRIPTION OF EMBODIMENT

Hereinafter, an embodiment in which the recording device is realized in an ink jet type printer will be described with reference to the drawings.

As shown in FIG. 1, a printer is provided with a base platform 12 as an example of a support unit that is configured to include a support frame 11 with a frame structure placed on the bottom surface thereof. An upper surface of the base platform 12 forms a support surface 13 on which a medium P is supported, and a plurality of suction holes 14 are open in the support surface 13. In addition, a decompression chamber 15 is provided in a bottom part of the support surface 13 of the base platform 12, and a vacuum pump 16 is connected to the decompression chamber 15. In addition, a first power source device 17, as an example of a first power source that is provided in the bottom part of the support surface 13 of the base platform 12, is connected to the vacuum pump 16 via a cable C1. Further, in a case in which the vacuum pump 16 is driven on the basis of power that is supplied from the first power source device 17 via the cable C1, a suction force acts on the medium P, which is supported on the support surface 13 of the base platform 12, via the suction holes 14 due to the decompression chamber 15 reaching a decompression atmosphere.

A guiding groove 18 is formed on a side surface of both sides (only one side is illustrated in FIG. 1) of the base platform 12 that run along a length direction X of the medium P. A bottom end part of a liquid ejecting unit 20, as an example of a gate type recording unit that extends in one direction, is engaged with the guiding groove 18 in a manner in which reciprocating movement along the length direction X of the medium P is possible.

In addition, a ball screw 21 is installed in the base platform 12 along a side surface of one side (the right side in FIG. 1) in the length direction X of the medium P. A drive mechanism 22 that is provided in a bottom end part of one side of the liquid ejecting unit 20 in a longitudinal direction thereof, is linked to the ball screw 21. The drive mechanism 22 is configured to include a nut member that engages with the ball screw 21, and a drive motor that performs rotational drive of the nut member in forward and reverse directions. A second power source device 23, as an example of a second power source that is provided on one side of the liquid ejecting unit 20 in a longitudinal direction thereof, is connected to the drive mechanism 22 via a cable C2. Further, in a case in which the drive motor of the drive mechanism 22 is driven on the basis of power that is supplied from the second power source device 23 via the cable C2, the liquid ejecting unit 20 performs reciprocating movement in the length direction X of the medium P while being guided by the guiding groove 18 due to the nut member of the drive mechanism 22 moving along the ball screw 21 while rotating.

The liquid ejecting unit 20 includes a main shaft 24 and an auxiliary shaft 25 that run along a longitudinal direction. A carriage 26, which extends in a direction that intersects the length direction X of the medium P, is supported by the shafts 24 and 25 in a manner in which sliding movement along the longitudinal direction is possible.

A drive pulley 27 and driven pulley 28 are supported in a freely rotatable manner at positions in the liquid ejecting unit 20 that correspond to both end parts of the shafts 24 and 25. In addition to an output shaft of a carriage motor 29, which acts as a drive source when performing reciprocating movement of the carriage 26, being linked to the drive pulley 27, an endless timing belt 30, a portion of which is linked to the carriage 26, is hung between the pair of pulleys 27 and 28. Therefore, the carriage 26 moves along the longitudinal direction of the shafts 24 and 25 via the endless timing belt 30 due to drive power of the carriage motor 29 while being guided by the shafts 24 and 25.

Ink cartridges 31 that accommodate UV curable ink (hereinafter, referred to as "UV ink") are arranged in a predetermined position on an end side (the right end side in FIG. 1) of the liquid ejecting unit 20 in the longitudinal direction thereof. The UV ink inside the ink cartridges 31 can be supplied toward a recording head 32 that is supported on a bottom surface side of the carriage 26 through an ink supply tube 33. Further, the recording head 32 performs printing on the medium P that is supported on the support surface 13 of the base platform 12 by ejecting the UV ink that is supplied from the ink cartridges 31.

In addition, a pair of irradiation instruments 35 are supported by both side surfaces of the carriage 26. The irradiation instruments 35 are supported by both sides in a movement direction of the carriage 26 with the recording head 32 interposed therebetween. In addition, the second power source device 23 is connected to the irradiation instruments 35 via a cable C3. Further, each irradiation instrument 35 cures UV ink by irradiating UV ink that is ejected onto the medium P with irradiating UV rays on the basis of power that is supplied from the second power source device 23 through the cable C3.

Next, a control configuration of the printer of the present embodiment will be described.

As shown in FIG. 2, the printer has a plurality of control substrates that include a first control substrate 40A and a second control substrate 40B. Each control substrate 40A and 40B is provided with CPUs 41A and 41B, reset ICs 42A and 42B, and non-volatile memories 43A and 43B. When a command is received from the CPUs 41A and 41B, the reset ICs 42A and 42B initiate a reset operation that returns respective operational states of the control substrates 40A and 40B to an initial state in the CPUs 41A and 41B. In addition, in a case in which the reset operation has been initiated by the reset ICs 42A and 42B, the CPUs 41A and 41B save respective operational states of the control substrates 40A and 40B on the non-volatile memories 43A and 43B.

A signal line S is connected between the first CPU 41A of the first control substrate 40A and the second CPU 41B of the second control substrate 40B, and the CPUs 41A and 41B of both of the control substrates 40A and 40B can mutually perform communication of various signals via the signal line S. In addition, the first power source device 17 and the second power source device 23 are respectively connected to the first CPU 41A of the first control substrate 40A and the second CPU 41B of the second control substrate 40B. The power source devices 17 and 23 are connected to a common AC power source 44, and after converting an AC voltage that is supplied from the AC power source 44 to a DC voltage, supply the converted DC voltage to the CPUs 41A and 41B of the control substrates 40A and 40B to which the power source devices 17 and 23 respectively correspond. In addition, in a case in which supply of an AC voltage from the AC power source 44 is terminated, the power source devices 17 and 23 transmit an AC OFF signal, which is an example of a power source OFF signal that shows that effect, to the CPUs 41A and 41B of the control substrates 40A and 40B to which the power source devices 17 and 23 correspond.

Additionally, in the present embodiment, the first control substrate 40A functions as the support control unit that controls various operations in the base platform 12. Further, the first control substrate 40A controls an adsorption operation of the medium P to the support surface 13 of the base platform 12 by controlling driving of the vacuum pump 16, for example. Meanwhile, the second control substrate 40B functions as the recording control unit that controls various operations in the liquid ejecting unit 20. Further, the second control substrate 40B controls a reciprocating operation of the liquid ejecting unit 20 along the length direction X of the medium P by controlling driving of the drive mechanism 22 for example, and controls an irradiation operation of UV light onto UV ink that is ejected onto the medium P by controlling driving of each irradiation instrument 35.

Next, a summary of a process routine of a reset operation that the printer of the present embodiment executes during an instantaneous power outage will be described with reference to the timing charts that are shown in FIG. 4.

Firstly, as shown in FIG. 3, when an instantaneous power outage occurs, supply of an AC voltage from the AC power source 44 to the first power source device 17 and the second power source device 23 is terminated. Then, the first power source device 17 immediately transmits an AC OFF signal, which shows that the supply of an AC voltage from the AC power source 44 has been terminated, to the first CPU 41A, as a power source OFF signal transmission step. Meanwhile, even if the supply of an AC voltage from the AC power source 44 has been terminated, the second power source device 23 does not transmit an AC OFF signal that shows that effect to the second CPU 41B immediately. That is, when the supply of an AC voltage to the from the AC power source 44 to each power source device 17 and 23 has been terminated, a timing of the transmission of an AC OFF signal from each power source device 17 and 23 to the CPUs 41A and 41B to which the power source devices 17 and 23 correspond is individually different in each power source device 17 and 23. The reason for this is that due to the fact that control targets of the control substrates 40A and 40B to which the DC voltages are supplied from each power source device 17 and 23 differ, conditions for initiating a reset operation of each control substrate 40A and 40B also differ.

Subsequently, when an AC OFF signal is received from the first power source device 17, the first CPU 41A writes an operational state of the first control substrate 40A of that time to the first non-volatile memory 43A (Step S11A). In addition, when an AC OFF signal is received from the first power source device 17, as a reset initiation signal transmission step, after saving the operational state of the second control substrate 40B at that time to the second CPU 41B as an interrupt operation, the first CPU 41A transmits a Non Maskable Interrupt (NMI) signal as an example of a reset initiation signal in order to initiate a reset operation. Further, when an NMI signal is received from the first CPU 41A, the second CPU 41B writes an operational state of the second control substrate 40B at that time to the second non-volatile memory 43B (Step S11B).

Subsequently, when a preparation process of the reset operation that includes writing to the first non-volatile memory 43A has been completed, the first CPU 41A transmits a signal that shows that effect to the first reset IC 42A. Then, the first CPU 41A initiates a reset operation due to a signal that prompts the initiation of a reset operation being transmitted from the first reset IC 42A to the first CPU 41A (Step S12A). Further, when the reset operation has been completed (Step S13A), as a reset completion signal transmission step, the first CPU 41A sets a synchronization signal, which is an example of a reset completion signal in order to perform mutual confirmation with the second CPU 41B of the completion or non-completion of the respectively reset operations, to High (Step S14A). In addition, after setting a self synchronization signal to High, the first CPU 41A initiates a request for a partner synchronization signal from the second CPU 41B.

Meanwhile, when a preparation process of the reset operation that includes writing to the second non-volatile memory 43B has been completed, the second CPU 41B transmits a signal that shows that effect to the second reset IC 42B. Then, the second CPU 41B initiates a reset operation due to a signal that prompts the initiation of a reset operation being transmitted from the second reset IC 42B to the second CPU 41B (Step S12B). Further, when the reset operation has been completed (Step S13B), after setting a self synchronization signal to High (Step S14B), the second CPU 41B initiates a request for a partner synchronization signal from the first CPU 41A.

That is, after setting the self synchronization signals thereof to High, the first CPU 41A and the second CPU 41B request a partner synchronization signal. Further, as a reset completion determination step, both of the CPUs 41A and 41B determine the fact that reset operations of both of the control substrates 40A and 40B have been completed by confirming the fact that a partner synchronization signal has been set to High. Further, as a reset completion signal termination step, after setting the self synchronization signals thereof to Low (Steps S15A and S15B), both of the CPUs 41A and 41B stand by until a new AC OFF signal is input from the power source devices 17 and 23.

More specifically, in the present embodiment, as shown in Parts (a) and (h) of FIG. 4, the supply of an AC voltage from the AC power source 44 to each power source device 17 and 23 is terminated at a time t1. Further, at this time, as shown in Parts (a) and (i) of FIG. 4, the supply of a DC voltage from each power source device 17 and 23 to the CPUs 41A and 41B of the control substrates 40A and 40B to which the power source devices 17 and 23 correspond is maintained. That is, even if the supply of an AC voltage from the AC power source 44 is terminated temporarily, the power source devices 17 and 23 maintain the supply of a DC voltage to the CPUs 41A and 41B of the control substrates 40A and 40B to which the power source devices 17 and 23 correspond using power that has been accumulated in an electrolytic capacitor or the like. In addition, at this time, as shown in Part (c) of FIG. 4, an AC OFF signal is transmitted from the first power source device 17 to the first CPU 41A at a time t2. Meanwhile, as shown in Part (j) of FIG. 4, an AC OFF signal is not transmitted from the second power source device 23 to the second CPU 41B at the same time t2.

Further, as shown in Part (d) of FIG. 4, the first CPU 41A initiates writing to the first non-volatile memory 43A at a time t3 after the AC OFF signal has been received from the first power source device 17. Subsequently, as shown in Part (e) of FIG. 4, the first CPU 41A initiates a reset operation on the basis of a signal that is received from the first reset IC 42A at a time t5 after a preparation process of the reset operation that includes writing to the first non-volatile memory 43A has been completed. Further, as shown in Part (g) of FIG. 4, after setting a synchronization signal to High, the first CPU 41A initiates a request for a synchronization signal from the second CPU 41B at a time t7 after the reset operation has been completed.

In this case, a reset operation of the second CPU 41B has not been completed at the time t7. Therefore, the first CPU 41A determines that the reset operation of the second CPU 41B has not been completed yet due to a Low signal being received as the synchronization signal from the second CPU 41B. Further, the first CPU 41A continues to request a synchronization signal from the second CPU 41B at fixed intervals while continuing to set a self synchronization signal as high until a High signal is received as the synchronization signal from the second CPU 41B.

In addition, as shown in Part (f) of FIG. 4, the first CPU 41A initiates the transmission of an NMI signal to the second CPU 41B at the time t3 after the AC OFF signal has been received from the first power source device 17. Then, as shown in Part (k) of FIG. 4, the second CPU 41B initiates writing to the second non-volatile memory 43B at a time t4 after the NMI signal has been received from the first CPU 41A. Additionally, as shown in Part (m) of FIG. 4, when the second CPU 41B initiates writing to the second non-volatile memory 43B with the reception of the NMI signal from the first CPU 41A as a trigger thereof, the first CPU 41A initiates writing to the first non-volatile memory 43A. Therefore, in this case, an NMI signal that prompts the initiation of writing to the first non-volatile memory 43A is not transmitted to the first CPU 41A from the second CPU 41B. Further, the second CPU 41B initiates a reset operation on the basis of a signal that is received from the second reset IC 42B at a time t6 after a preparation process of the reset operation that includes writing to the second non-volatile memory 43B has been completed. In addition, as shown in Part (n) of FIG. 4, after setting a synchronization signal to High, the second CPU 41B initiates a request for a synchronization signal from the first CPU 41A at a time t8 after the reset operation has been completed.

In this case, a reset operation of the first CPU 41A has already been completed at the time t8. Therefore, the second CPU 41B determines that the reset operation of the first CPU 41A has already been completed due to a High signal being received as the synchronization signal from the first CPU 41A. In addition, at the same time, the first CPU 41A determines that the reset operation of the second CPU 41B has already been completed due to a High signal being received as the synchronization signal from the second CPU 41B.

Further, as shown in Parts (g) and (n) of FIG. 4, after the setting self synchronization signals thereof to Low, the first CPU 41A and the second CPU 41B stand by until a new AC OFF signal is input from the power source devices 17 and 23 at a time t9 after it has been determined that the reset operation of a partner CPU has been completed.

Additionally, in the present embodiment, a self synchronization signal is set to Low at a time point at which the first CPU 41A determines that a reset operation of the second CPU 41B has been completed, that is, when a short amount of time has passed after the time t8 at which the synchronization signal of the second CPU 41B is set to High. The reason for this is that, a short time lag is generated between a time point at which the second CPU 41B sets the self synchronization signal thereof to High along with the completion of the reset operation until the synchronization signal of the first CPU 41A is received. Further, if the synchronization signal of the first CPU 41A is set to low before the second CPU 41B determines completion of the reset operation of the first CPU 41A as a result of this time lag, it is not possible for the second CPU 41B to determine completion of the reset operation of the first CPU 41A. In such an instance, in the present embodiment, the synchronization signal of the first CPU 41A is set to low after securing a period of time from when the synchronization signal of the second CPU 41B is set to High to when the second CPU 41B receives the synchronization signal of the first CPU 41A.

Next, effects of the printer of the present embodiment will be described.

In the present embodiment, the base platform 12 and the liquid ejecting unit 20 are provided with the power source devices 17 and 23, which respectively act as supply sources of power. Further, the second power source device 23 that supplies power to the liquid ejecting unit 20 is integral with the liquid ejecting unit 20, and performs reciprocating movement along the length direction X of the medium P. Therefore, even if the liquid ejecting unit 20 performs reciprocating movement in a manner that crosses above the medium P that is supported on the support surface 13 of the base platform 12 in the length direction X of the medium P, a relative position of the liquid ejecting unit 20 and the second power source device 23 according to the reciprocating movement of the liquid ejecting unit 20 does not change. That is, a distance between the liquid ejecting unit 20 and the second power source device 23 does not change according to the reciprocating movement of the liquid ejecting unit 20. Therefore, the lengths of the cables C2 and C3 that lead from the second power source device 23 to the liquid ejecting unit 20 can be reduced further than a case in which the length of the cables C2 and C3 that lead from the second power source device 23 to the liquid ejecting unit 20 are made long to an extent at which the cables do not interfere with the reciprocating movement of the liquid ejecting unit 20 in consideration of a range through which the liquid ejecting unit 20 performs reciprocating movement. Therefore, since a circumstance in which a voltage drop occurs when a voltage is supplied from the second power source device 23 to the liquid ejecting unit 20 via the cables C2 and c3 is suppressed, the operation of the liquid ejecting unit 20 can be performed stably.

In addition, in the present embodiment, the first control substrate 40A and the second control substrate 40B respectively control the operation of the targets thereof while mutually performing communication of various items of information. Therefore, when a timing with which an AC OFF signal is transmitted from a power source when an instantaneous power outage has arisen is relatively fast, and only the first control substrate 40A has initiated a reset operation, it is possible to that a communication error will occur between the control substrates 40A and 40B, and the entire operation of the printer will be terminated.

With respect to this, in the present embodiment, when the first control substrate 40A initiates a reset operation when an instantaneous power outage has arisen, the transmission of an NMI signal from the first control substrate 40A to the second control substrate 40B is also performed. Therefore, even if an AC OFF signal is not transmitted from the second power source device 23 to the second control substrate 40B when an instantaneous power outage has arisen, the second control substrate 40B initiates a reset operation with the reception of an NMI signal from the first control substrate 40A as a trigger thereof. Therefore, since both of the first control substrate 40A and the second control substrate 40B reliably perform a reset operation when an instantaneous power outage arises, the occurrence of communication errors between the control substrates 40A and 40B is suppressed.

In the manner described above, according to the above-mentioned embodiment, it is possible to obtain the effects that are shown below.

(1) The liquid ejecting unit 20 includes an individual second power source device 23 that is separate from the first power source device 17 that is provided in the base platform 12. Therefore, even if the liquid ejecting unit 20 has a configuration of moving relatively in a direction that runs along the support surface 13 with respect to the base platform 12, the cables C2 and C3 that lead from the second power source device 23 do not interfere with the relative movement. Therefore, due to the fact that it is possible to shorten the length of the cables C2 and C3 that lead from the second power source device 23, it is possible to suppress a voltage drop from occurring in a voltage that is supplied from the second power source device 23 to the liquid ejecting unit 20 via the cables C2 and C3.

(2) When one of the control substrates of the first control substrate 40A and the second control substrate 40B initiates a reset operation, the other control substrate initiates a reset operation after performing an operational state save operation. Therefore, since there is not a circumstance in which only one of the control substrates of the first control substrate 40A and the second control substrate 40B performs a reset operation, it is possible to avoid the occurrence of communication errors between the control substrates 40A and 40B.

(3) Due to the first control substrate 40A and the second control substrate 40B mutually transmitting synchronization signals, it is possible to determine whether or not the reset operations of both of the control substrates 40A and 40B have been completed.

(4) Each of the first control substrate 40A and the second control substrate 40B sets the synchronization signal thereof to low after the reset operations of both of the control substrates 40A and 40B have been completed. Therefore, it is possible for each of the first control substrate 40A and the second control substrate 40B to return to a stand-by state, in which reception of a new AC OFF signal from the power source that corresponds thereto is possible, after it has been determined that the reset operation of a partner control substrate has been completed.

Additionally, the present embodiment can be realized in the following forms.

In the present embodiment, the first control substrate 40A may initiate a request for a synchronization signal from the second control substrate 40B with the reception of an AC OFF signal from the first power source device 17 as a trigger thereof.

In the present embodiment, the second control substrate 40B may initiate a request for a synchronization signal from the first control substrate 40A with the reception of an NMI signal from the first control substrate 40A as a trigger thereof.

In the present embodiment, after a reset operation has been completed, each of the first control substrate 40A and the second control substrate 40B need not transmit a signal that shows that effect to the partner control substrate. That is, as long as the first control substrate 40A has a configuration that prompts the initiation of a reset operation in the second control substrate 40B when an AC OFF signal is received from the first power source device 17, each of the first control substrate 40A and the second control substrate 40B need not determine whether or not the reset operation of a partner substrate has been completed.

In the present embodiment, the communication of information in the control configuration of the printer was performed on the basis of a signal potential that is retained between High and Low, but the communication of the information may be performed on the basis of serial communication or the like that uses a command signal.

In the present embodiment, the printer as the recording device may be any line head type printer which forms images by fixing either a recording head or a medium and moving the other, and in which nozzles that are arranged in a direction that intersects the length direction of the medium are provided to correspond to length in a direction that interests the length direction of the medium.

In the present embodiment, the printer as the recording device may be any fluid ejecting device that performs recording by ejecting or discharging a fluid other than ink (including liquid state materials that are formed by particles of a liquid or a functional material being dispersed, or mixed into a liquid, fluid states such as gels, and solid that can be fluidized and ejected as fluid). For example, any liquid ejecting apparatus that performs printing by ejecting a liquid state material that includes materials such as electrode materials and color materials (pixel materials), which are used in the manufacturing of liquid crystal displays, EL (electroluminescence) displays, surface-emitting displays and the like in a dispersed or dissolved form may be used. In addition, a fluid form material ejecting apparatus that ejects a fluid form material such as a gel (for example, a physical gel), or a granule ejecting apparatus (for example, a toner jet type printing apparatus) that ejects a solid of which a powder (a granular material) such as toner is an example of, may be used. Further, it is possible to adopt the present invention in these kinds of fluid ejecting devices. Additionally, in the present specification, "fluid" refers to a concept that does not include a fluid that is formed from gas only and for example, includes liquids (inorganic solvents, organic solvents, liquid solutions, liquid resins, liquid metals (metallic melts)), liquid state materials, fluid state materials, granular materials (including powder and granules), and the like.

The entire disclosure of Japanese Patent Application No. 2014-045722, filed Mar. 7, 2014 is expressly incorporated by reference herein.

REFERENCE SIGNS LIST

12 Base platform as an example of a support unit
13 Support surface
17 First power source device as an example of a first power source
20 Liquid ejecting unit as an example of a recording unit
23 Second power source device as an example of a second power source
26 Carriage
32 Recording head
40A First control substrate as an example of a support control unit
40B Second control substrate as an example of a recording control unit
P Medium

The invention claimed is:

1. A recording device comprising:

a support unit that includes a support surface that supports a medium; and a recording unit, which is capable of moving relatively in a direction that runs along the support surface with respect to the medium that is supported on the support unit, and which performs a recording operation on the medium from a recording head, wherein the support unit includes a first power source, and a support control unit that controls operation of the support unit on the basis of power that is supplied from the first power source, and the recording unit includes a second power source, and a recording control unit that controls operation of the recording unit on the basis of power that is supplied from the second power source, wherein the support control unit and the recording control unit are capable of executing a reset operation that returns respective operational states to an initial state, and in a case in which one control unit of the support control unit and the recording control unit has initiated the reset operation, the corresponding control unit transmits a reset initiation signal, which initiates the reset operation after causing an operational state save operation to be performed, to the other control unit, and wherein the support control unit and the recording control unit are capable of mutually transmitting a reset completion signal in a case in which the respective reset operations have been completed, and each control unit determines whether or not the reset operation of both control units has been completed on the basis of whether or not the reset completion signal has been transmitted from a partner control unit in a state in which a self-reset operation has been completed.

2. The recording device according to claim 1, wherein each control unit terminates transmission of the reset completion signal to the partner control unit in a case in which the reset completion signal has been transmitted from the partner control unit in a state in which the self-reset operation has been completed.

3. A recording method that is used in a recording device that is provided with a support unit that includes a support surface that supports a medium, and a recording unit, which is capable of moving relatively in a direction that runs along the support surface with respect to the medium that is supported on the support unit, and which performs a recording operation on the medium from a recording head, in which the support unit includes a first power source, and a support control unit that controls operation of the support unit on the basis of power that is supplied from the first power source, and the recording unit includes a second power source, and a recording control unit that controls operation of the recording unit on the basis of power that is supplied from the second power source, the recording method causing the recording device to execute a power source OFF signal transmission step of transmitting a power source OFF signal, which shows that supply of power from the first power source and the second power source has been terminated, from the first power source and the second power source to the control units to which the first power source and the second power source correspond;

a reset initiation signal transmission step of transmitting a reset initiation signal, which initiates a reset operation, from a control unit to which the power source OFF signal was transmitted in the power source OFF signal transmission step to a partner control unit after causing an operational state save operation to be performed;

a reset completion signal transmission step of mutually transmitting a reset completion signal in a case in which the support control unit and the recording control unit have completed the respective reset operations, and a reset completion determination step of causing each control unit determine whether or not the reset operations of both control units have been completed on the basis of whether or not the reset completion signal was transmitted from a partner control unit in the reset completion signal transmission step in a state in which a self-reset operation has been completed.

4. The recording method according to claim 3, further causing the recording device to execute a reset completion signal termination step of causing each control unit to terminate transmission of the reset completion signal to the partner control unit in the reset completion determination step in a case in which it is determined that the reset operation of the partner control unit has been completed.

* * * * *